US005812097A

United States Patent [19]

Maldonado

[11] Patent Number: 5,812,097

[45] Date of Patent: Sep. 22, 1998

[54] DUAL BAND ANTENNA

[75] Inventor: David Maldonado, San Diego, Calif.

[73] Assignee: Qualcomm Incorporated, San Diego, Calif.

[21] Appl. No.: 641,321

[22] Filed: Apr. 30, 1996

[51] Int. Cl.[6] ..... H01Q 9/04

[52] U.S. Cl. ..... 343/790; 343/702; 343/895

[58] Field of Search ..... 343/702, 790, 343/791, 792, 895, 749, 750, 900; H01Q 9/04, 1/24

[56] References Cited

U.S. PATENT DOCUMENTS

| | | | |
|---|---|---|---|
| 3,100,893 | 8/1963 | Brueckmann | 343/792 |
| 3,139,620 | 6/1964 | Leidy et al. | 343/792 |
| 4,095,229 | 6/1978 | Elliott | 343/715 |
| 4,117,492 | 9/1978 | Arnold | 343/792 X |
| 4,121,218 | 10/1978 | Irwin et al. | 343/702 |
| 4,152,705 | 5/1979 | Kowols | 343/750 |
| 4,180,819 | 12/1979 | Nakano | 343/792 |
| 4,280,129 | 7/1981 | Wells | 343/715 |
| 4,285,065 | 8/1981 | Priniski | 455/158 |
| 4,395,714 | 7/1983 | Takeda et al. | 343/725 |
| 4,490,727 | 12/1984 | Kowols | 343/895 |
| 4,494,122 | 1/1985 | Garay et al. | 343/722 |
| 4,725,845 | 2/1988 | Phillips | 343/702 |
| 4,748,450 | 5/1988 | Hines et al. | 343/791 X |
| 4,860,024 | 8/1989 | Egashira | 343/702 |
| 4,862,182 | 8/1989 | Egashira | 343/702 |
| 4,890,114 | 12/1989 | Egashira | 343/702 |
| 4,940,989 | 7/1990 | Austin | 343/792 X |
| 4,958,382 | 9/1990 | Imanishi | 455/277 |
| 5,014,346 | 5/1991 | Phillips et al. | 455/89 |
| 5,048,117 | 9/1991 | Aisaka et al. | 455/89 |
| 5,072,230 | 12/1991 | Taniyoshi et al. | 343/715 |
| 5,079,562 | 1/1992 | Yarsunas et al. | 343/792 |
| 5,095,541 | 3/1992 | Aisaka et al. | 455/89 |
| 5,170,173 | 12/1992 | Krenz et al. | 343/702 |
| 5,202,696 | 4/1993 | Sheriff | 343/741 |
| 5,204,687 | 4/1993 | Elliott et al. | 343/702 |
| 5,231,412 | 7/1993 | Eberhardt et al. | 343/790 |
| 5,300,936 | 4/1994 | Izadian | 343/700 |
| 5,406,296 | 4/1995 | Egashira et al. | 343/715 |
| 5,550,554 | 8/1996 | Erkocevic | 343/702 X |
| 5,594,461 | 1/1997 | O'Neill | 343/895 |

FOREIGN PATENT DOCUMENTS

| | | | |
|---|---|---|---|
| 2689688 | 10/1993 | France | H01Q 25/00 |
| 3826777 | 2/1990 | Germany | H01Q 21/30 |
| 8402614 | 7/1984 | WIPO | H01Q 9/16 |

*Primary Examiner*—Donald T. Hajec
*Assistant Examiner*—Tho Phan
*Attorney, Agent, or Firm*—Russell B. Miller; Roger W. Martin

[57] ABSTRACT

A novel and improved dual band antenna system comprising an inner antenna element surrounded by an outer antenna element. In a first embodiment, the inner antenna element radiates and receives RF signals in a first RF band, and the outer antenna element radiates and receives RF signals in a second RF band. Optionally, the inner and outer antennas may be coupled together when operating in the first RF band in order to improve the antenna gain pattern of the dual band antenna. In a second embodiment, the inner antenna element radiates and receives RF signals in both the first and second RF bands. In this second embodiment, when operating in the second RF band, the outer antenna element is grounded, thus altering the signal length of the inner antenna element to resonate in the second RF band.

6 Claims, 4 Drawing Sheets

DUAL BAND ANTENNA

BACKGROUND OF THE INVENTION

I. Field of the Invention

The present invention relates to radio communications. More particularly, the present invention relates to a novel and improved dual band antenna in a radiotelephone.

II. Description of the Related Art

Wireless forms of communications are rapidly becoming the standard means for communication. Home cordless telephones, lap top computers with wireless modems, satellite radiotelephones, and cellular radiotelephones are all examples of how technology is evolving to enable people to stay in touch at any location.

Users of radiotelephones are looking for smaller and lighter devices to meet their increasingly mobile lifestyle. In order to fill this demand, multiple communication functions are being combined into a single unit. An example of such a communication device is a radiotelephone that communicates in multiple frequency bands.

There are a variety of different radiotelephone systems in use today. These include the cellular systems such as those based on Advanced Mobile Phone System (AMPS), Time Division Multiple Access (TDMA), and Code Division Multiple Access (CDMA). Additionally, personal communication services (PCS) systems based on the two digital standards (TDMA and CDMA) are rapidly being developed that allow one to use a radiotelephone at home or the office as a cordless telephone then switch to a cellular service once out of the range of the home/office station.

The PCS systems and the cellular systems operate in different frequency bands, thus requiring different antennas for maximum transmission efficiency. The cellular systems typically operate in the 800 Mhz band while PCS systems are presently being designed for operation in the 1900 Mhz band. There is a resulting need for a lighter and less costly dual-band antenna system to allow operation of a single communications device in multiple frequency bands.

SUMMARY OF THE INVENTION

The present invention is a novel and improved dual band antenna apparatus. The antenna apparatus communicates a first set of signals in a first radio frequency band and a second set of signals in a second radio frequency band. The antenna apparatus is comprised of an inner antenna element surrounded by an outer antenna element.

In a first embodiment of the present invention, the inner antenna element radiates and receives RF signals in the first RF band, and the outer antenna element radiates and receives RF signals in the second RF band. In this first embodiment, the inner antenna has a signal length of one-half wavelength in the first RF band, and the outer antenna has a signal length of one-half wavelength in the second RF band. Optionally, the inner and outer antennas may be coupled together when operating in the first RF band in order to improve the antenna gain pattern of the dual band antenna.

In a second embodiment of the present invention, the inner antenna element radiates and receives RF signals in both the first and second RF bands. In this second embodiment, the inner antenna has a signal length of one-half wavelength of the first RF band when operating in the first RF band, and also has a signal length of one-half wavelength of the second RF band when operating at the second RF band. When operating in the second RF band, the outer antenna element is grounded, thus altering the signal length of the inner antenna element to resonate in the second RF band. Similarly to the first embodiment, the inner and outer antennas optionally may be coupled together when operating in the first RF band in order to improve the antenna gain pattern of the dual band antenna.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

In the preferred embodiment of the present invention, the dual band antenna is efficiently operative at two frequency bands—800 Mhz cellular, and 1.9 Ghz PCS. However, it should be noted during the following discussion that the teachings of the present invention are equally applicable to other frequency bands and applications. For example, cellular systems in many parts of the world operate at 900 Mhz instead of 800 Mhz. Likewise, PCS systems in many parts of the world operate at 1.8 Ghz instead of 1.9 Ghz. For the purposes of illustration, it will be sufficient to describe a dual band antenna operative at both 800 Mhz and 1.9 Ghz.

Figure 1:
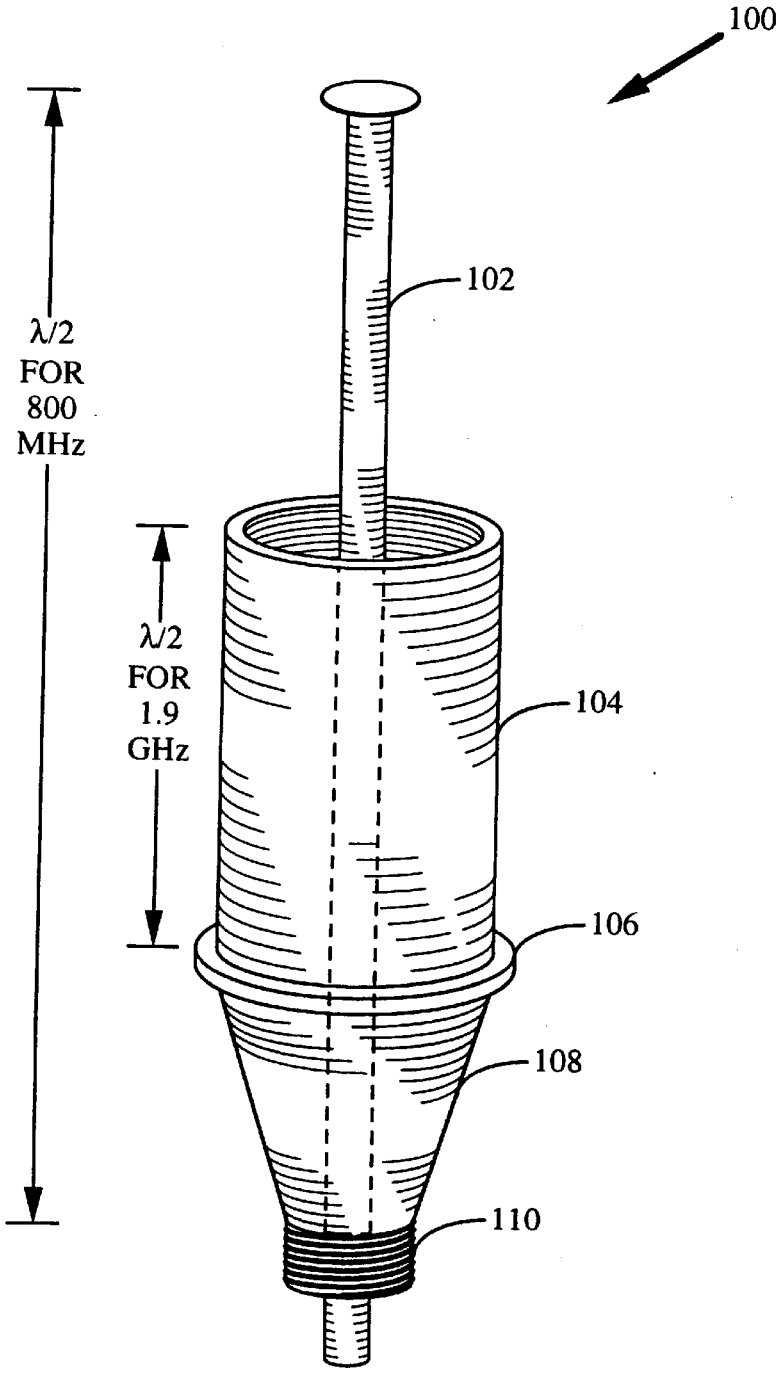
FIG. 1 illustrates a first embodiment of the dual band antenna of the present invention.

FIG. 1 illustrates a first embodiment of the dual band antenna. This embodiment is comprised of an inner whip antenna 102 surrounded by a conductive sleeve antenna 104. The sleeve antenna 104 is coupled to a feed point 106 that provides the PCS-band signals. The inner whip antenna 102 is coupled to a feed point 110 that supplies the cellular-band signals. Feed point 106 and 110 are preferably separated by an insulator 108. The physical dimensions of sleeve antenna 104 are chosen such that sleeve antenna 104 acts as an efficient RF resonator at 1.9 Ghz, whereas whip antenna 102 acts as an efficient RF resonator at 800 Mhz.

Figure 5:
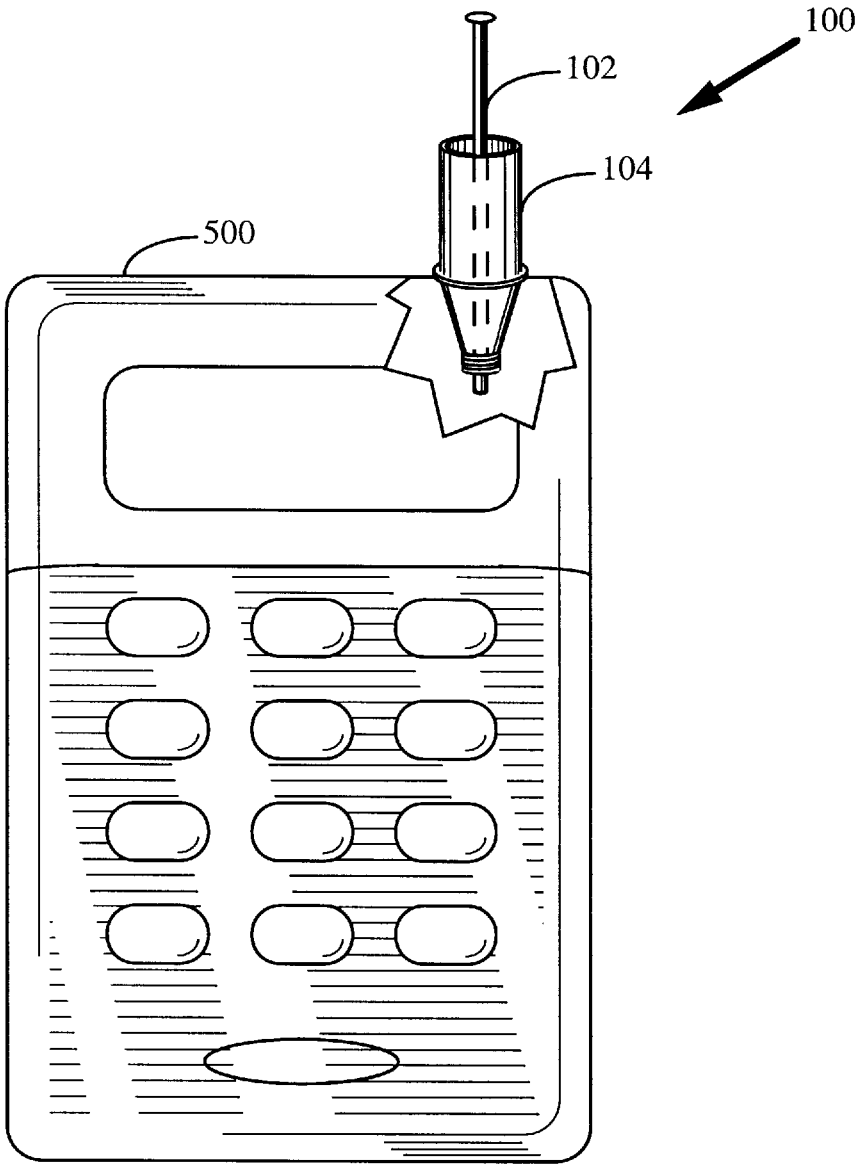
FIG. 5 illustrates the second embodiment of the dual band antenna of the present invention interfacing with a portable radiotelephone suitable for use with the present invention.

The selection of the physical dimensions of each antenna 102 and 104 is partially dependent on the RF characteristics of equipment in close proximity to dual-band antenna 100. For example, when dual-band antenna is employed in a portable radiotelephone 500 as shown in FIG. 5, the housing and structure of the radiotelephone 500 itself receives and radiates a measurable amount of RF energy, acting as a type of supplemental antenna. Thus, standard practice in the art is to take into account the RF characteristics of the surrounding structure when choosing the signal length of the antenna. Common signal lengths for portable radiotelephone antennas are ⅜ and ⅝ of a wavelength at the operating frequency. However, for purposes of explanation, the present invention will be described with reference to a whip antenna 102 which has a signal length of one-half a wavelength at 800 Mhz, and a sleeve antenna 104 which has a signal length of one-half a wavelength at 1.9 Ghz.

It should be noted that sleeve antenna 104 may be of various constructions as are known in the art. For example, it may be solid, helical, or braided. It also may be either rigid or flexible, and may be further encased in a dielectric material such as plastic (not shown). Likewise, it should also be noted that whip antenna 102 may be of various constructions as are known in the art. For example, it may be a fixed length whip, a telescopic whip, a loop array, or helical. Clearly, many different constructions for both sleeve antenna 104 and whip antenna 102 may be devised as long as sleeve antenna 104 substantially surrounds whip antenna 102. Optionally, a dielectric insulator (not shown) may also be inserted between whip antenna 102 and sleeve antenna 104.

Figure 2:
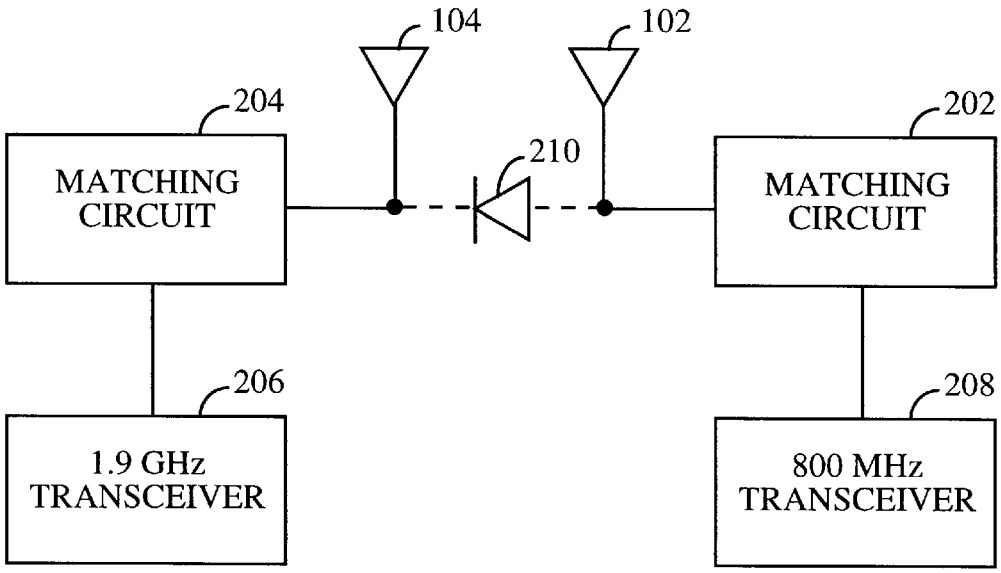
FIG. 2 is a block diagram of the first embodiment of the dual band antenna of the present invention.

The electrical connection of the first embodiment of the present invention is shown in block diagram representation in FIG. 2. In FIG. 2, a 1.9 Ghz transceiver 206 is shown coupled to sleeve antenna 104 through impedance matching circuit 204. RF signals generated by 1.9 Ghz transceiver 206 are radiated by sleeve antenna 104, and RF signals captured by sleeve antenna 104 are received and demodulated by 1.9 Ghz transceiver 206. Similarly, an 800 Mhz transceiver 208 is shown coupled to whip antenna 102 through impedance matching circuit 202. RF signals generated by 800 Mhz transceiver 208 are radiated by whip antenna 102, and RF signals captured by whip antenna 102 are received and demodulated by 800 Mhz transceiver 208.

When a radio employing the dual-band antenna embodiment of FIGS. 1 and 2 is operating in the 1.9 Ghz frequency band, only sleeve antenna 104 radiates and receives RF energy. However, when the radio is operating in the 800 Mhz frequency band, signals radiated by whip antenna 102 are also coupled to sleeve antenna 104, providing for a more even antenna gain pattern that would be achieved by whip antenna 102 alone. Nulls that would normally be present in the antenna gain pattern of whip antenna 102 are partially filled in by the coupling of RF energy to sleeve antenna 104.

Optionally, a diode 210 may be connected between impedance matching circuits 202 and 204 such that both whip antenna 102 and sleeve antenna 104 are directly fed by RF signals from 800 Mhz transceiver 208. In this configuration, the antenna gain pattern at 800 Mhz is even further improved due to direct feeding of the signal to sleeve antenna 104 rather than inductive or capacitive coupling. However, diode 210 blocks RF signals to whip antenna 102 when the phone is operating in the 1.9 Ghz frequency band to avoid undesirable efficiency loss. Note that diode 210 may be replaced by a switch that couples sleeve antenna 104 to matching circuit 202 when operating at 800 Mhz, and de-couples sleeve antenna 104 from matching circuit 202 when operating at 1.9 Ghz.

Figure 3:
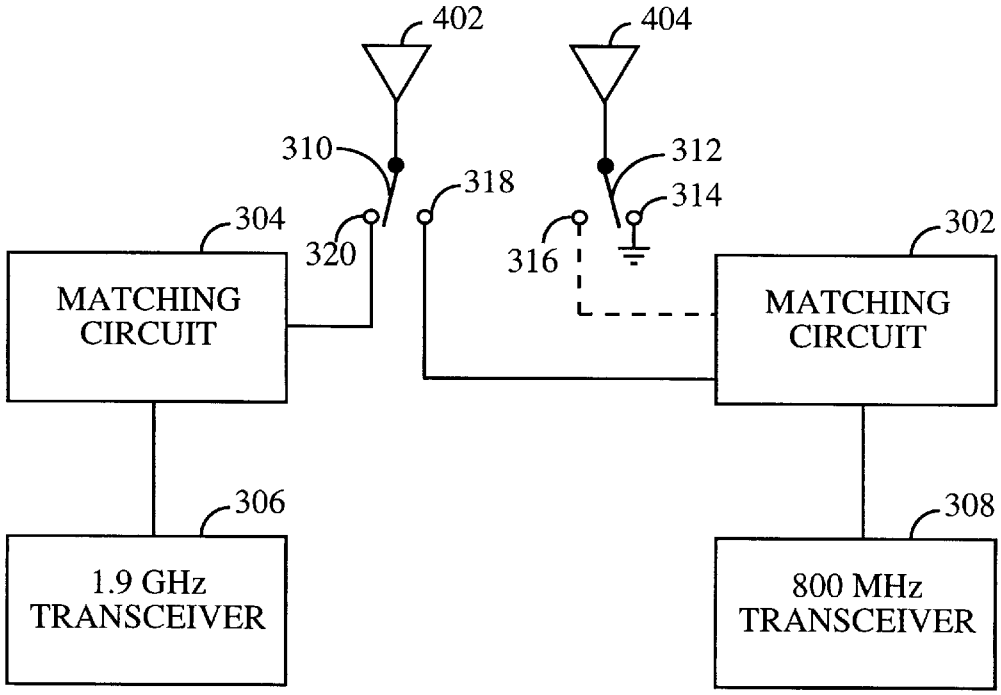
FIG. 3 is a block diagram of a second embodiment of the dual band antenna of the present invention.
Figure 4:
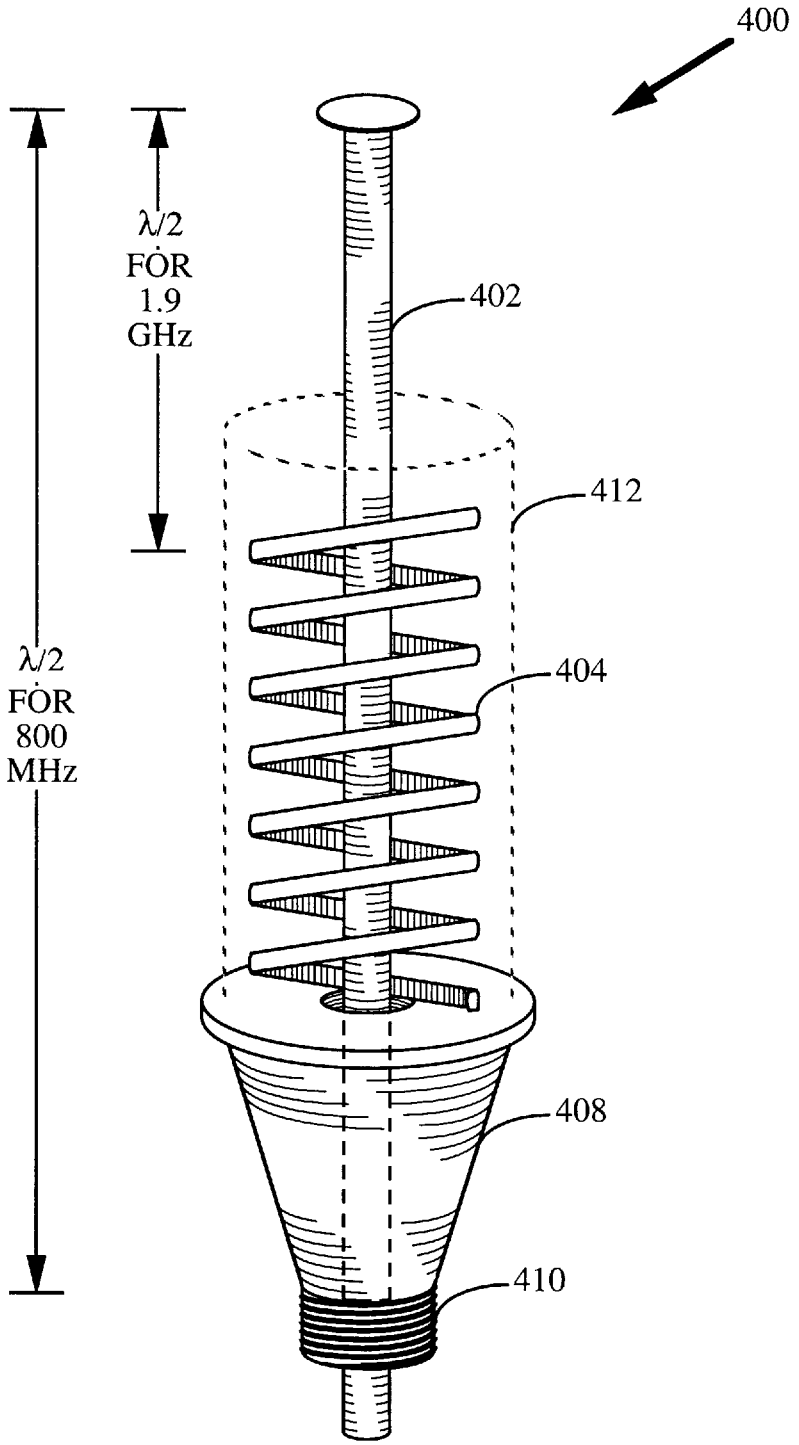
FIG. 4 illustrates the second embodiment of the dual band antenna of the present invention.

A second embodiment of the present invention is illustrated in FIG. 4. In FIG. 4, sleeve antenna 404 is shown to be a helical antenna, substantially surrounding whip antenna 402. The portion of whip antenna 402 extending from the top of sleeve antenna 404 is of a signal length of one-half wavelength at 1.9 Ghz. The operation of this second embodiment is shown in block diagram format in FIG. 3. In this second embodiment, 1.9 Ghz transceiver 306 and 800 Mhz transceiver 308 are coupled through their respective matching circuits 304 and 302 to a pair of switches 310 and 312. Sleeve antenna 404 is coupled to one pole of switch 312, and whip antenna 402 is coupled to one pole of switch 310. When a phone employing this second embodiment is operating in the 800 Mhz frequency band, switch 310 is coupled to terminal 318, and switch 312 is not coupled to ground terminal 314, thus providing 800 Mhz RF signals to whip antenna 402. As was stated previously with respect to the first embodiment, the antenna gain pattern of whip antenna 402 is improved by the presence of the surrounding sleeve antenna 404. Optionally, when the phone employing this second embodiment is operating in the 800 Mhz frequency band, switch 312 may be coupled to optional terminal 316, further improving the antenna gain pattern due to direct feeding of the signal to sleeve antenna 404 rather than inductive or capacitive coupling.

In contrast to the first embodiment, when a phone employing this second embodiment is operating in the 1.9 Ghz frequency band, RF signals are not radiated or received through the sleeve antenna 404. Instead, the 1.9 Ghz signals are radiated and received on whip antenna 402 by coupling switch 310 to terminal 320, while sleeve antenna 404 is grounded by coupling switch 312 to ground terminal 314. It should be noted that although switches 310 and 312 are depicted as two separate switches in FIG. 3, they may also be implemented as one double-pole, double-throw switch.

As can be seen in FIG. 4, sleeve antenna 404 (shown here as a helical antenna) surrounds whip antenna 402. Thus, since sleeve antenna 404 is grounded during 1.9 Ghz operation, the effective feed point for 1.9 Ghz signals provided to whip antenna 402 shifts from feed point 410 to the top of sleeve antenna 404 because sleeve antenna 404 shields any portion of whip antenna 402 which it surrounds. Thus, in contrast to the first embodiment, where the physical length of sleeve antenna 404 was chosen such that its signal length was one-half wavelength at 1.9 Ghz, the physical length of sleeve antenna 404 in the second embodiment is chosen such that the signal length of the portion of whip antenna 402 that protrudes from the top of sleeve antenna 404 is one-half wavelength at 1.9 Ghz.

As was previously stated with respect to FIG. 1, sleeve antenna 404 may be of various constructions as are known in the art. For example, it may be solid, helical, or braided. It also may be either rigid or flexible, and may be further encased in a dielectric material 412 such as plastic. Clearly, many different constructions for both sleeve antenna 404 and whip antenna 402 may be devised as long as sleeve antenna 404 substantially surrounds whip antenna 402.

Referring now to FIG. 5, a portable radiotelephone 500 employing the dual-band antenna 100 of the present invention is shown. In the preferred embodiment, sleeve antenna 104 is exposed externally to the housing of radiotelephone 500 while whip antenna 102 may be extended to an exposed position, or retracted to a stored position within the housing of radiotelephone 500. In operation in either frequency band, whip antenna 102 is preferably extended to the exposed position for optimum performance. However, the user of portable radiotelephone 500 need not readjust dual-band antenna 100 when switching from 800 Mhz operation to 1.9 Ghz operation, or vice-versa. Additionally, when whip antenna 102 is retracted to a stored position, dual-band antenna 100 becomes compact and rugged. Alternatively, the entire dual-band antenna assembly 100 may be retractable within the housing of radiotelephone 500.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. A dual band antenna system, comprising:

a first antenna element having a feed point for receiving a first RF signal within a first frequency band and a second RF signal within a second frequency band, said fast antenna element for transmitting said first and second RF signals;

a second antenna element, substantially surrounding said first antenna element, for altering an electrical length of said first antenna element when said fist antenna element is transmitting said second RF signal;

a first switch for coupling said first antenna element to said first RF signal when said first antenna element is transmitting said first RF signal and for coupling said first antenna element to said second RF signal when said first antenna element is transmitting said second RF signal; and a second switch for coupling said second antenna element to ground when said first antenna element is transmitting said second RF signal.

2. The dual band antenna system of claim 1 wherein said first antenna element has a signal length of one-half a wavelength at said first frequency band when said second antenna element is not coupled to ground, and wherein said first antenna element has a signal length of one-half a wavelength at said second frequency band when said second antenna element is coupled to ground.

3. The dual band antenna system of claim 2 wherein said first antenna element is a whip antenna and said second antenna element is a sleeve antenna.

4. The dual band antenna system of claim 3 wherein said second switch couples said second antenna element to said first RF signal when said first antenna element is transmitting said first RF signal.

5. The dual band antenna system of claim 4 further comprising an insulator for electrically isolating said first antenna element from said second antenna element.

6. The dual band antenna system of claim 1 further comprising:

a first transceiver for generating said first RF signal;

a first matching circuit, coupled to said first transceiver and said first antenna element, for matching an impedance of said first antenna element at said first frequency band;

a second transceiver for generating said second RF signal; and a second matching circuit, coupled to said second transceiver and said first antenna element, for matching an impedance of said first antenna element at said second frequency band.

* * * * *